US005217050A

United States Patent [19]

Varlet

[11] Patent Number: 5,217,050

[45] Date of Patent: Jun. 8, 1993

[54] METHOD OF VACUUM PACKAGING PASTE OR LIQUID PRODUCTS IN A DISPENSER, DEVICE FOR IMPLEMENTING THIS METHOD

[75] Inventor: Jean-Pierre Varlet, Le Neubourg, France

[73] Assignee: Valois, Le Neubourg, France

[21] Appl. No.: 777,925

[22] Filed: Oct. 17, 1991

[30] Foreign Application Priority Data

Oct. 17, 1990 [FR] France ..... 90 12806

[51] Int. Cl.[5] ..... B65B 1/03; B65B 3/04; B67C 3/00

[52] U.S. Cl. ..... 141/2; 141/21; 141/26; 141/119; 141/275; 53/510

[58] Field of Search ..... 53/510, 432; 141/2, 141/18, 21, 25, 26, 65, 269, 275, 277, 116, 119

[56] References Cited

U.S. PATENT DOCUMENTS

| | | | |
|---|---|---|---|
| 1,893,716 | 1/1933 | Ronzone | 53/510 |
| 3,911,972 | 10/1975 | Hübers et al. | 141/275 |
| 3,996,725 | 12/1976 | Walles | 53/510 |
| 4,254,806 | 3/1981 | Elsworth | 141/116 |

FOREIGN PATENT DOCUMENTS 0276983 1/1988 European Pat. Off. .

*Primary Examiner*—Henry J. Recla
*Assistant Examiner*—Steven O. Douglas
*Attorney, Agent, or Firm*—Sughrue, Mion, Zinn, Macpeak & Seas

[57] ABSTRACT

Some paste or liquid products, used as cosmetics and medicines, for example, have to be protected from contact with air. Methods have been developed for vacuum packaging them. These methods are more concerned with eliminating air that may remain in the packaging filled with the product at the time the latter is closed (by welding, by sealed fixing of a dispensing valve, etc). No special precautions are taken during filling of the packaging which is carried out in air and inevitably causes unwanted air bubbles to be trapped. The present method avoids any inclusion of air in the product. The packaging, which consists of a variable volume reservoir, is filled while in its maximum content configuration in an hermetically sealed enclosure that is evacuated. The enclosure is formed by a bucket receiving the reservoir and to which a bell fits in a sealed way. The bell is connected to a system of vacuum pumps and to a store of the product. Communication is established by means of a non-return valve at the outlet of an injector tube. A metering cylinder is used to isolate a volume of product equal to the maximum content of the reservoir R and then to discharge this via a three-way valve.

21 Claims, 2 Drawing Sheets

METHOD OF VACUUM PACKAGING PASTE OR LIQUID PRODUCTS IN A DISPENSER, DEVICE FOR IMPLEMENTING THIS METHOD

BACKGROUND OF THE INVENTION

1. Field of the invention

The present invention concerns a method of vacuum packaging paste or liquid products in dispensers. The products concerned are usually cosmetic products or medicines which must be protected from contact with air because of the risk of oxidation or contamination. The dispenser usually comprises a variable volume reservoir (a deformable bottle, a tube closed by a piston, etc) closed in a sealed way by a dispensing valve which prevents ingress of air. The valve is advantageously associated with a precompression pump to guarantee clean dispensing and an acceptable rate of product feed. A device for implementing this method is also part of the invention, as are the resulting dispensers.

2. Description of the prior art

One prior art vacuum packaging method is disclosed in the U.S. Pat. No. 4,845,927 to RAPPARINI with the priority date of Jan. 21, 1987. It consists in first filling a small sac with the product to be packaged through an open side of the sachet. The filled sachet is then placed in a bucket so that the open side of the sac is at the top of the bucket. A bell is then lowered to hermetically seal the top of the bucket. The sachet is therefore enclosed in an enclosure from which the air is evacuated by a system of vacuum pumps. The patent then discloses that jaws are used to hot seal the open side of the small sac. It is only after this welding operation that the enclosure is returned to atmospheric pressure and the sachet is removed from the bucket by raising the bell.

In June 1988 the company VALOIS adapted this method to flexible tubes containing toothpaste. They used the idea of enclosing the tube in an enclosure adapted to be evacuated and inside which the bottom of the tube was then sealed before returning the enclosure to atmospheric pressure. The same company disclosed in French patent application No 89-14260 filed Oct. 31, 1989 a comparable method for attaching a dispensing valve to a bottle. Once vacuum was established in the enclosure, the valve was crimped to the bottle, for example, inside the enclosure and using clamps disposed for this purpose in the bell of the enclosure.

Although the use of a vacuum enclosure for sealing the packaging is particularly effective in the case of vacuum packaging a paste or liquid product, it does not enable all of the air to be eliminated from the dispenser finally obtained. If any air is trapped within the product itself, vacuum is not established in the enclosure, i.e. at the surface of the product contained in the reservoir of the dispenser which is still open at this time makes it impossible to evacuate it. It is therefore better if no air is included in the product in the dispenser. For this the reservoir must be filled with sufficient care.

The problem of trapping air bubbles arises in a particularly acute manner in the case of a tube with a piston such as that shown in axial cross-section in FIG. 1. This particular type of reservoir R comprises a cylindrical tube 10 whose bottom 13 is open. A cover 16 held by a sleeve 12 adapted to be force-fitted around the lower perimeter 14 of the tube 10 can be provided to protect the open bottom 13 from inadvertent pressure by the user and from soiling. Behind the cover 16, which has a vent hole 17, is a piston 50 adapted to move along the tube 10. A double lip seal 51 at its perimeter provides a seal at the area of contact between the piston and the tube.

A preferred form of the piston 50 is shown in the appended FIGS. 1 through 3. On its outside it comprises a ring 52 which projects sufficiently to abut against the cover 16 when the piston 50 is in the lowermost position (associated with the maximum content of the tube 10). Another ring 53 is provided on its inside. Its diameter, greater than that of the previous ring 52, is such that a dispensing valve V crimped to the neck 15 of the tube 10 is able to fit inside the ring 53 when the piston 50 reaches its uppermost position (associated with the minimum content of the tube 10). At this time the ring 53 abuts against the base of the neck 15.

The product can be fed into a tube 10 of this kind in two different ways using known filling techniques carried out at atmospheric pressure. The first (not shown) has the piston 50 remain at its lowermost position throughout the operation. An injector tube is then lowered through the open neck 15 of the tube 10 into the immediate vicinity of the piston 50. It delivers the product and is raised relative to the tube 10 as the quantity of product injected increases. Care is taken to keep the end of the injector tube above the surface of the product. This minimizes the risk of air bubbles becoming trapped in the product already introduced. However, the inclusion of small volumes of air is inevitable in practise. The presence of the ring 53 favors the occurrence of this unwanted phenomenon.

A second filling method already mentioned consists in starting with the piston 50 at the uppermost position (see FIG. 2). An injector tube 200 is inserted through the neck 15 of the tube 10 as in the first method. However, its end 201 is simply placed within the ring 53 of the piston 50. It is attached to a plug 210 which seals the neck 15 and so is isolated from the external environment. As schematically represented in FIG. 3, product 80 is then injected with sufficient pressure to push down the piston 50 as further quantities of product are introduced. On completion of filling by this method the volume of air initially contained between the piston 50 and the plug 210, that is to say in the neck 15, to all intents and purposes, remains trapped, the injection pressure causing it to be mixed with the product to form an emulsion 81.

An object of the present invention is to propose a method of vacuum packaging paste or liquid products in which the filling of the dispenser reservoir avoids any trapping of air bubbles. It must be particularly effective when the reservoirs are tubes closed by pistons like those just described.

This object is achieved by a new use of the enclosure previously used in the prior art for sealing dispensers in vacuum.

SUMMARY OF THE INVENTION

The present invention discloses a method of vacuum packaging a paste or liquid product in a dispenser in the form of a reservoir comprising an opening and means for varying its volume and a dispensing member adapted to prevent ingress of air and to close off in a sealed way said reservoir, said method comprising an operation of filling said reservoir with said product which is carried out when said reservoir is in a maximum content configuration in an evacuated hermetically sealed enclosure.

To be more precise, prior to said filling operation:

said reservoir is placed in a bucket having an open top so that said opening is above said top;

said bucket is closed by means of a bell to constitute said hermetically sealed enclosure, said bell comprising filling means; and said vacuum is created in said hermetically sealed enclosure.

Said bucket is advantageously displaced vertically by an actuator which moves it into contact with said bell to constitute said hermetically sealed enclosure. Said hermetically sealed enclosure is formed when said bell and said bucket are in contact with each other via a gasket attached to said bell. Said vacuum may be created by means of a system of vacuum pumps communicating with said bell via at least one pipe.

Said filling means preferably comprise an injector tube attached to said bell so that when said hermetically sealed enclosure is formed one end of said injector tube is inserted in said opening of said reservoir, a valve being adapted to close said injector tube except during a filling operation so that said vacuum created in said hermetically sealed enclosure does not cause said product to be aspirated into said enclosure via said injector tube. In this case, during a filling operation a quantity of said product equal to said maximum content of said reservoir isolated by means of a metering cylinder is advantageously expelled by a piston through said injector tube, said valve being an hydraulic valve adapted to allow said quantity of said product to pass by virtue of the force exerted by said piston. Said metering cylinder is then, for example, filled with said product prior to said filling operation via a valve and from a store of said product in which a vacuum is maintained.

For example, after said filling operation said hermetically sealed enclosure is returned to atmospheric pressure and then said bucket and said bell are separated from each other to release said filled reservoir. In this case, following release of said reservoir said dispensing member is fitted into said opening and fixed in a vacuum to terminate said method.

Said means for varying the volume of said reservoir advantageously consists in a piston and said dispensing member is a precompression metering pump adapted to dispense a creme product.

The present invention also discloses a device for implementing the above method. It comprises a bucket having an open top adapted to receive said reservoir so that said opening is above said top, a bell adapted to close said bucket to constitute said hermetically sealed enclosure, there being filling means in said bell, and means for creating a vacuum in said hermetically sealed enclosure.

Finally, dispensers obtained by use of the present method are part of the invention. They are characterized in that their content consists exclusively of said product, air being totally absent.

A specific embodiment of the invention will now be described by way of non-limiting example with reference to the appended drawings.

DETAILED DESCRIPTION OF THE INVENTION

Figure 1:
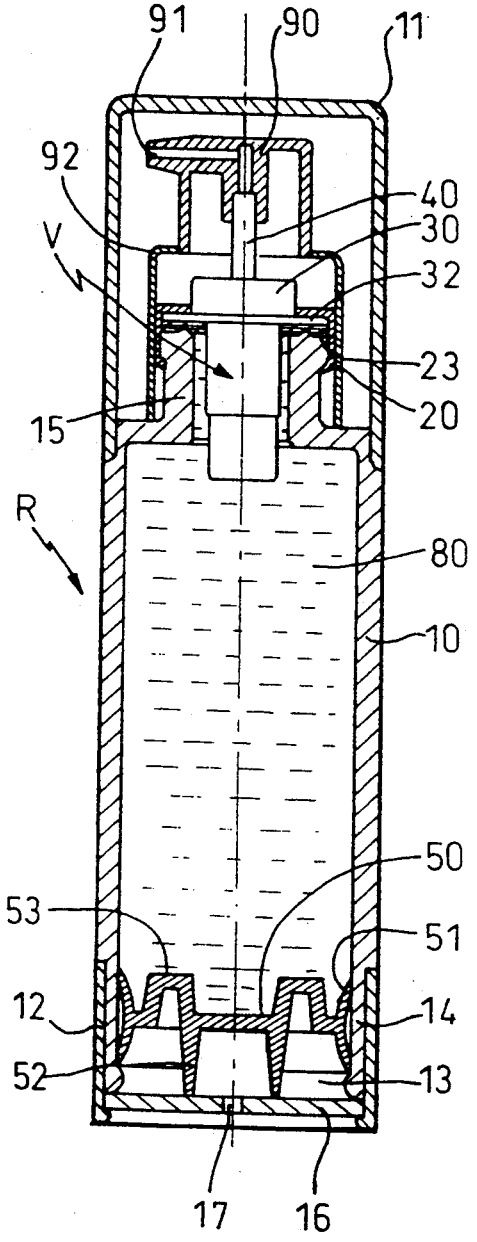
FIG. 1 is a view in axial cross-section of a dispenser with which the present invention may be advantageously employed and in the form of a tube with a piston and a dispensing valve.
Figure 2:
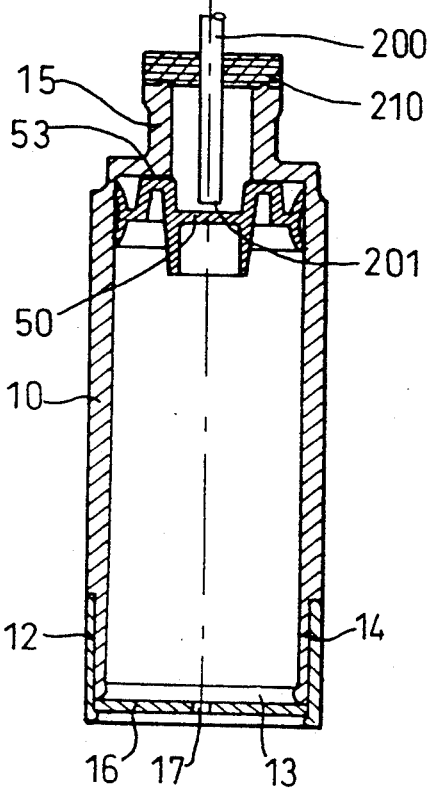
FIGS. 2 and 3 are views in axial cross-section of the tube and piston from FIG. 1 respectively shown at the start of and during filling with the product by a prior art method.
Figure 3:
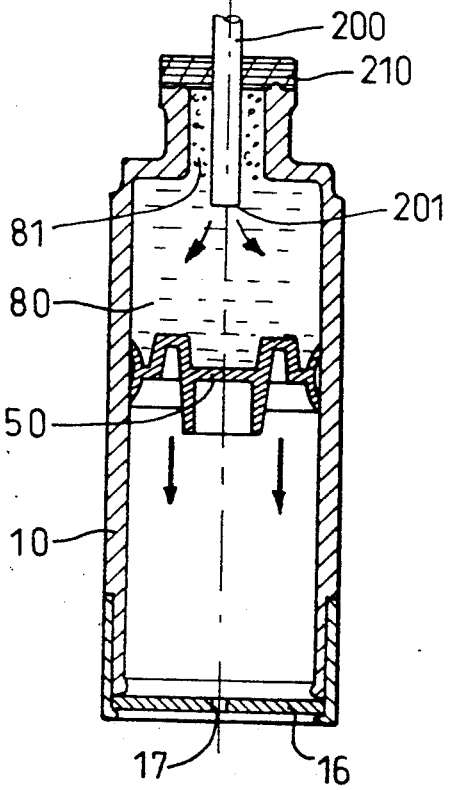

The tube and piston shown in FIGS. 1 through 3 have already been described in the above part of this disclosure concerning the prior art. It is necessary at this point to describe how a dispenser is advantageously presented on completion of vacuum packaging by a method in accordance with the invention and using this type of reservoir R. FIG. 1 shows a dispenser of this kind in cross-section. Partially inserted into the neck 15 of the tube 10 is a dispensing valve V advantageously associated with a precompression metering pump adapted to dispense a creme product. The body of the pump is accommodated within the neck 15 and a valve stem 40 projects to the exterior through a "turret" 30 which comprises an annular flange 32 resting on the neck 15 of the tube 10. A seal 23 is placed between the neck and the flange 32. A crimped collar 20 attaches the valve V to the tube 10 and seals the fixing.

Referring to FIG. 1, a cylindrical guide 92 is disposed around the neck 15 of the tube 10. It guarantees proper actuation of the valve stem 40 by a pushbutton 90. This procures sideways dispensing of the product which is fed from the stem 40 to a nozzle 91 through a right-angle passage in the pushbutton 90. A cap 11 is adapted to snap onto the tube 10 over the dispensing means that have just been described. It should be borne in mind that these are described here only as one illustration of a dispenser that can be obtained using a vacuum packaging method in accordance with the present invention.

Figure 4:
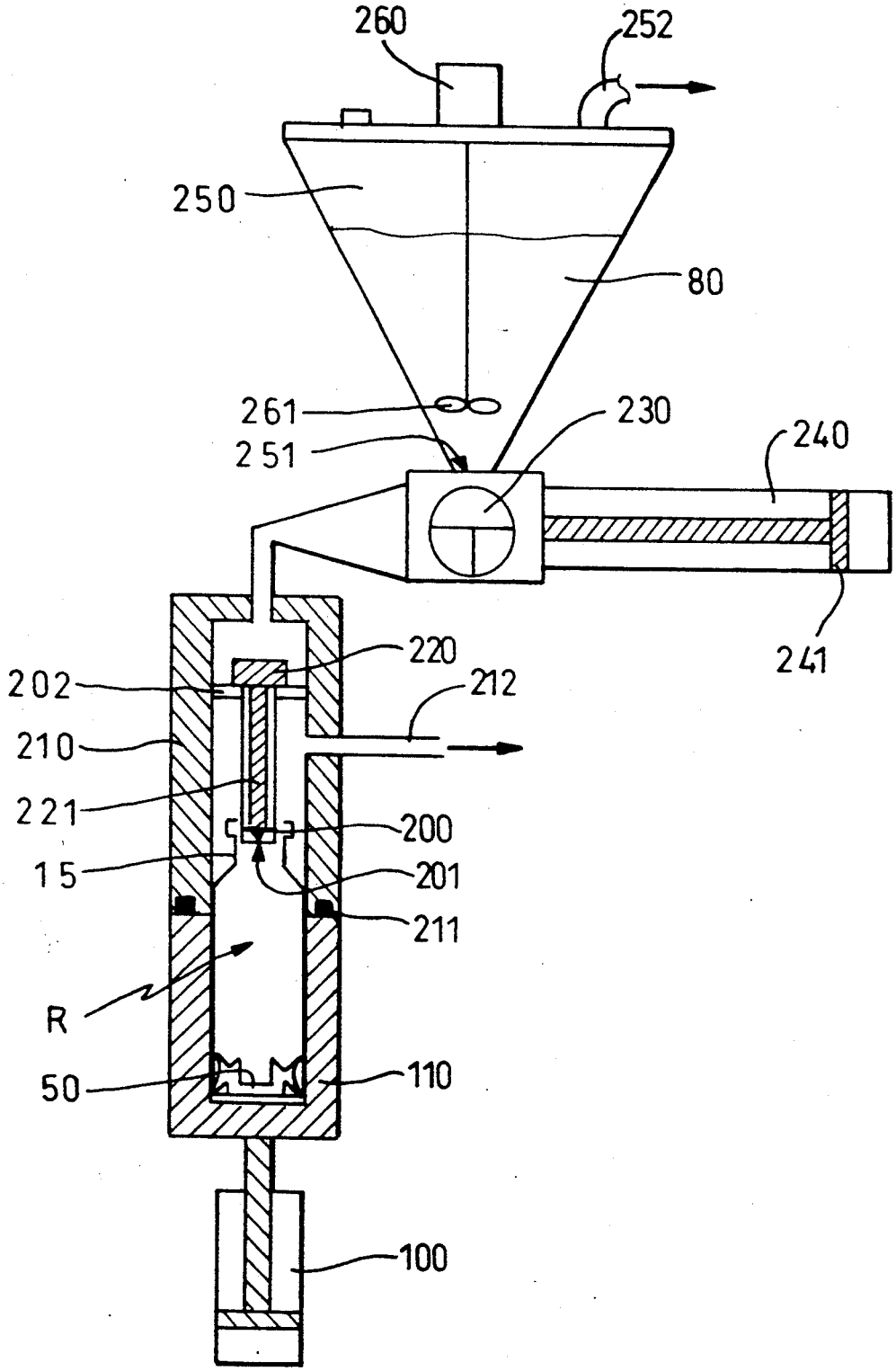
FIG. 4 is a diagram showing the filling of a tube with a piston by one embodiment of the vacuum packaging method in accordance with the invention and showing all the component parts of a device for implementing the method in accordance with the invention.

FIG. 4 is a diagram showing one particularly important phase of this method. It relates to the operation of filling the reservoir R. The latter is accommodated in an open-top bucket 110. In the case of the tube and piston as previously described, the bucket which is in the configuration in which it has its maximum content. In other words, its piston 50 is at the lowermost position. The cover 16 and the sleeve 12 are advantageously assembled to the tube 10. Filling is usually carried out on the premises of the manufacturer of the product and the reservoirs are supplied by a different company which carries out all tasks not directly related to filling. The neck 15 of the reservoir R is accessible above the open top of the bucket 110.

A bell 210 is brought into contact with the bucket 110 to close it. Referring to FIG. 4, this can be done by means of an actuator 100 adapted to raise the bucket when it is vertically aligned with the bell 210. The man skilled in the art will know many ways to transfer it to this location (for example, from a station in which it is loaded with the reservoir R): turntable, conveyor belt, etc. Likewise, the closure of the bucket by the bell can be achieved by displacement means of greater or lesser complexity, the present disclosure being restricted to the operating principle.

The bottom of the bell 210 carries a thick gasket 211 so that its contact with the bucket 110 is sealed. The reservoir R is thereafter in an hermetically sealed enclosure. It communicates via at least one pipe 212 with a vacuum pump system, however. This system is not shown and the arrow issuing from the pipe 212 represents the evacuation of air initially contained in the enclosure.

Inside the bell 210 is an injector tube 200 adapted to feed product into the reservoir R and attached to a support 202 fastened to the bell 210, for example. Its length is calculated so that its end 201 is automatically positioned in the neck 15 as soon as the bell and bucket are in contact. In other words, there is no provision for subsequent relative movement of the end 201 and the reservoir R, in particular while the reservoir is being filled.

The product 80 which is then fed in through the injector tube 200 is taken from a hopper 250, for example. In this example, the hopper is evacuated. This is schematically represented in FIG. 4 by the arrow issuing from the pipe 252. In the narrower part of the hopper, a stirrer 261 driven by a motor 260 advantageously prevents compacting of the product impeding evacuation of the content of the hopper 250 through its bottom orifice 251.

The orifice 251 does not communicate directly with the injector 200 because the vacuum in the hopper 250 and in the enclosure opposes the transfer of material. A valve 230 controls its opening. FIG. 4 shows a three-way valve. This is a plug valve, for example, its male part comprising three holes. It is therefore possible to establish communication either between the hopper 250 and a metering cylinder 240 schematically represented in FIG. 4 to the right of the valve 230 or between the metering cylinder 240 and the bell 210.

In the latter case the communication is further governed by a hydraulic valve 220. The FIG. 4 diagram merely indicates that a valve of this kind comprises a plunger 221 adapted to collaborate with a seat. In this example this seat is advantageously the end 201 of the injector tube 200, which to this end has a smaller diameter that the interior of the part of the injector tube 200 in which the plunger 221 is placed. The hydraulic valve 220 also comprises a piston head held away from the product on the side opposite the plunger 221 by a spring (not shown). The pressurized product can get under the head from the side from which the plunger 221 is upstanding.

The various members disposed between the orifice 251 of the hopper and the end 201 of the injector tube pass a quantity of product equivalent to the maximum content of the reservoir R from the hopper into the reservoir. This is achieved in one cycle of the piston 241 of the metering cylinder 240 which must be driven by an appropriate power source (not shown). In addition to drawing off the required quantity, the cylinder 240 guarantees that the injection pressure is sufficient to hold the hydraulic valve 220 open. This valve prevents the vacuum created in the enclosure aspirating in an uncontrolled way product on the upstream side of the injector tube. The combination of these means therefore constitutes an advantageous device for implementing the filling method in accordance with the present invention.

The filling method as just described ensures that at no time during the transfer of the metered quantity of product into the reservoir R is it in contact with air. Consequently, it cannot contain any air bubbles, however small. The packaging operation can then be completed by sealing the reservoir R in vacuum using a known method. In the case of a tube and piston as here, the valve V is advantageously crimped on in vacuum as disclosed in the previously mentioned French patent application No 89-14260. Note that it is then more practical to re-establish atmospheric pressure in the enclosure of FIG. 4 in order to separate the bell 210 from the bucket 110 and to place the valve V in the neck 15 of the reservoir. The contact of the free surface of the product with the atmosphere does not risk compromising the benefit of the filling operation as described above. Dispensers vacuum packaged with total absence of trapped air are also part of the present invention.

There is claimed:

1. Method of vacuum packaging a paste or liquid product in a dispensing container in the form of a reservoir comprising an opening and means for varying its volume and a dispensing member adapted to prevent ingress of air and to close off in a sealed way said reservoir, said method comprising in:

disposing said reservoir in its maximum content configuration in a bucket having an open top so that said opening is above said top;

closing said bucket by means of moving said bucket in contact with a bell to constitute an hermetically sealed enclosure, said bell comprising filling means comprising an injector tube which is coupled to said bell so that, when said hermetically sealed enclosure is formed, an outlet end of said injector tube is engaged in said opening of said reservoir;

creating a vacuum in said hermetically sealed enclosure; and feeding said product in vacuum into said reservoir through said injector tube at a sufficient pressure to hold open a valve which closes said outlet end of said injector tube at all times except during a filling operation so that said vacuum created in said hermetically sealed enclosure does not cause said product to be aspirated into said enclosure via said injector tube.

2. Vacuum packaging method according to claim 1 wherein during a filling operation a quantity of said product equal to the maximum content of said reservoir is isolated by means of a metering cylinder and is expelled by a piston through said injector tube, said valve being a hydraulic valve, which comprises a plunger extending through said injector tube and having an end which is operative to open and close said outlet end of said injector tube, and which allows said quantity of said product to pass by virtue of the force exerted by said piston.

3. Vacuum packaging method according to claim 2 wherein said metering cylinder is filled with said product prior to said filling operation via an additional valve and from a store of said product in which a vacuum is maintained.

4. Vacuum packaging method according to claim 3 wherein said store of said product is a hopper having a lower orifice at the level of which said additional valve is disposed and a motor driving a stirrer in said product near said orifice so that said product is evaluated via said orifice with substantially no compaction of said product.

5. Vacuum packaging method according to claim 3 wherein said additional valve is a three-way valve for establishing communication either between said store and said metering cylinder or between said metering cylinder and said injector tube.

6. Vacuum packaging method according to claim 5 wherein said three-way valve is a plug valve, its male part having three holes.

7. Vacuum packaging method according to claim 1 wherein said bucket is displaced vertically by a ram which brings it into contact with said bell to constitute said hermetically sealed enclosure.

8. Vacuum packaging method according to claim 1 wherein said hermetically sealed enclosure to constituted by said bell and said bucket brought into contact with each other via a gasket attached to said bell.

9. Vacuum packaging method according to claim 1 wherein said vacuum is created by a system of vacuum pumps which communicate with said bell via at least one pipe.

10. Vacuum packaging method according to claim 1 wherein after said filling operation said hermetically sealed enclosure is returned to atmospheric pressure and said bucket and said bell are separated from each other to release said filled reservoir.

11. Vacuum packaging method according to claim 10 wherein following release of said reservoir said dispensing member is fitted into said opening and fixed in a vacuum to terminate said method.

12. Vacuum packaging method according to claim 1 wherein said means for varying the volume of said reservoir consist in a piston and said dispensing member is a precompression metering pump adapted to dispense a creme product.

13. Device for vacuum packaging a paste or liquid product in a dispensing container formed by a reservoir comprising an opening and means for varying its volume and a dispensing member allowing no ingress of air adapted to close said reservoir in a sealed way, said device comprising:

a bucket having an open top for receiving said reservoir so that said opening is above said top;

a bell for closing said bucket to constitute an hermetically sealed enclosure;

filling means in said bell comprising an injector tube including an outlet end and being attached to said bell so that, when said hermetically sealed enclosure is formed, said outlet end of said injector tube is inserted in said opening of said reservoir;

means for creating a vacuum in said hermetically sealed enclosure;

means for creating an internal pressure in said injector tube during a filling operation; and a valve which closes said outlet end of said injector tube at all times except when said internal pressure is created in said injector tube so that said vacuum created in said hermetically sealed enclosure does not cause product to be aspirated into said enclosure via said injector tube.

14. Device according to claim 13 wherein said valve is a hydraulic valve, which comprises a plunger extending through said injector tube and having an end which is operative to open and close said outlet end of said injector tube, and which allows a quantity of said product to pass that is equal to said maximum content of said reservoir which is isolated in a metering cylinder and expelled by a piston through said injector tube.

15. Device according to claim 14 wherein said metering cylinder communicates via an additional valve with a store of said product held in a vacuum.

16. Device according to claim 15 wherein said store of said product is a hopper having a bottom orifice at the same level as said additional valve and a motor driving a stirrer in said product near said orifice so that said product is evacuated with substantially no compaction thereof via said orifice.

17. Device according to claim 15 wherein said additional valve is a three-way valve to establish communication either between said store and said metering cylinder or between said metering cylinder and said injector tube.

18. Device according to claim 17 wherein said three-way valve is a plug valve its male part having three holes.

19. Device according to claim 13 wherein said bucket is mounted on an actuator which displaces said bucket vertically to move it into contact with said bell to constitute said hermetically sealed enclosure.

20. Device according to claim 13 wherein said bell has a gasket disposed to seal said hermetically sealed enclosure when applied to said bucket.

21. Device according to claim 13 wherein said means for creating a vacuum in said hermetically sealed enclosure comprise at least one system of vacuum pumps communicating with said bell via at least one pipe.

* * * * *